US006796844B1

(12) United States Patent
Edwards, III

(10) Patent No.: US 6,796,844 B1
(45) Date of Patent: Sep. 28, 2004

(54) SYSTEM AND METHOD FOR COUPLING A PLURALITY OF CABLES TO A DEVICE

(75) Inventor: James W. Edwards, III, Austin, TX (US)

(73) Assignee: Cisco Technology, Inc., San Jose, CA (US)

( * ) Notice: Subject to any disclaimer, the term of this patent is extended or adjusted under 35 U.S.C. 154(b) by 5 days.

(21) Appl. No.: 10/359,856

(22) Filed: Feb. 7, 2003

(51) Int. Cl.[7] ..... H01R 33/92
(52) U.S. Cl. ..... 439/638; 439/676
(58) Field of Search ..... 439/540.1, 638, 439/676, 639, 923, 651, 701, 344

(56) References Cited

U.S. PATENT DOCUMENTS

| | | | | |
|---|---|---|---|---|
| 5,254,973 A | | 10/1993 | Gilmore, II | 340/547 |
| 5,387,110 A | | 2/1995 | Kantner et al. | 439/59 |
| 5,418,891 A | | 5/1995 | Yang | 395/114 |
| 5,518,416 A | | 5/1996 | Kantner et al. | 439/352 |
| 5,535,274 A | | 7/1996 | Braitberg et al. | 379/446 |
| 5,615,344 A | | 3/1997 | Corder | 395/309 |
| 5,779,499 A | * | 7/1998 | Sette et al. | 439/540.1 |
| 5,822,427 A | | 10/1998 | Braitberg et al. | 379/454 |
| 6,062,910 A | | 5/2000 | Braquet et al. | 439/620 |
| 6,123,564 A | * | 9/2000 | Belmore, III | 439/344 |
| 6,217,228 B1 | | 4/2001 | Samela et al. | 385/59 |
| 6,222,910 B1 | | 4/2001 | Price et al. | 379/93.37 |
| 6,321,340 B1 | * | 11/2001 | Shin et al. | 439/638 |
| 6,466,366 B1 | | 10/2002 | Dominique | 359/379 |
| 6,547,585 B2 | * | 4/2003 | Bradley et al. | 439/701 |
| 6,558,201 B1 | * | 5/2003 | Begley et al. | 439/638 |
| 6,595,798 B1 | * | 7/2003 | Pook | 439/540.1 |
| 6,611,147 B2 | | 8/2003 | White et al. | 324/539 |

* cited by examiner

*Primary Examiner*—P. Austin Bradley
*Assistant Examiner*—Felix O. Figueroa
(74) *Attorney, Agent, or Firm*—Baker Botts L.L.P.

(57) ABSTRACT

An apparatus includes a housing having a first side and a second side, and a plurality of Registered Jack (RJ) plugs attached to the first side. A plurality of RJ jacks is also included in the device. The RJ jacks are disposed within the second side of the housing. Each RJ jack is electrically connected to a corresponding one of the plurality of RJ plugs on the first side of the housing. The apparatus also includes a securing mechanism associated with at least one of the plurality of plugs. The securing mechanism is operable to releasably connect the plurality of plugs to a second plurality of RJ jacks on the device, thereby facilitating insertion of the plurality of plugs into the second plurality of jacks.

20 Claims, 4 Drawing Sheets

SYSTEM AND METHOD FOR COUPLING A PLURALITY OF CABLES TO A DEVICE

TECHNICAL FIELD OF THE INVENTION

This invention relates generally to data communications and more particularly to a system and method for coupling a plurality of cables to a device.

BACKGROUND OF THE INVENTION

Ethernet switches, and other types of devices, are often utilized in rugged environments such as a factory floor. Due to such a rugged environment, Ethernet switches may be damaged and need replacement. However, downtime associated with replacement of an Ethernet switch can often be expensive due to lost operability.

Conventionally, if it is desired to replace an Ethernet switch, all cables must be unplugged from the switch and then plugged back into a replacement Ethernet switch. It is important that each Ethernet cable be inserted into the replacement Ethernet device at the correct jack for proper operation of the switch. However, it is often difficult to rapidly insert all cables in the correct location. This contributes to additional expense associated with downtime.

In addition to Ethernet switches, attaching a plurality of cables to any device can be time consuming, and replacing such a device can be expensive in certain circumstances.

SUMMARY OF THE INVENTION

According to one embodiment of the invention, an apparatus includes a housing having a first side and a second side, and a plurality of Registered Jack (RJ) plugs attached to the first side. A plurality of RJ jacks is also included in the device. The RJ jacks are disposed within the second side of the housing. Each RJ jack is electrically connected to a corresponding one of the plurality of RJ plugs on the first side of the housing. The apparatus also includes a securing mechanism associated with at least one of the plurality of plugs. The securing mechanism is operable to releasably connect the plurality of plugs to a second plurality of RJ jacks on the device, thereby facilitating insertion of the plurality of plugs into the second plurality of jacks.

Some embodiments of the invention provide numerous technical advantages. Some embodiments may benefit from some, none, or all of these advantages. For example, according to one embodiment of the invention, a ganged connector is utilized to facilitate coupling of a plurality of cables to a single device. By using such a ganged connector, the device may be replaced easily without requiring selective configuration of the plurality of cables within the device. Thus, downtime, which may be expensive, may be reduced, resulting in lower operation costs.

Other technical advantages may be readily ascertained by one of skill in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF THE INVENTION

Figure 1A:
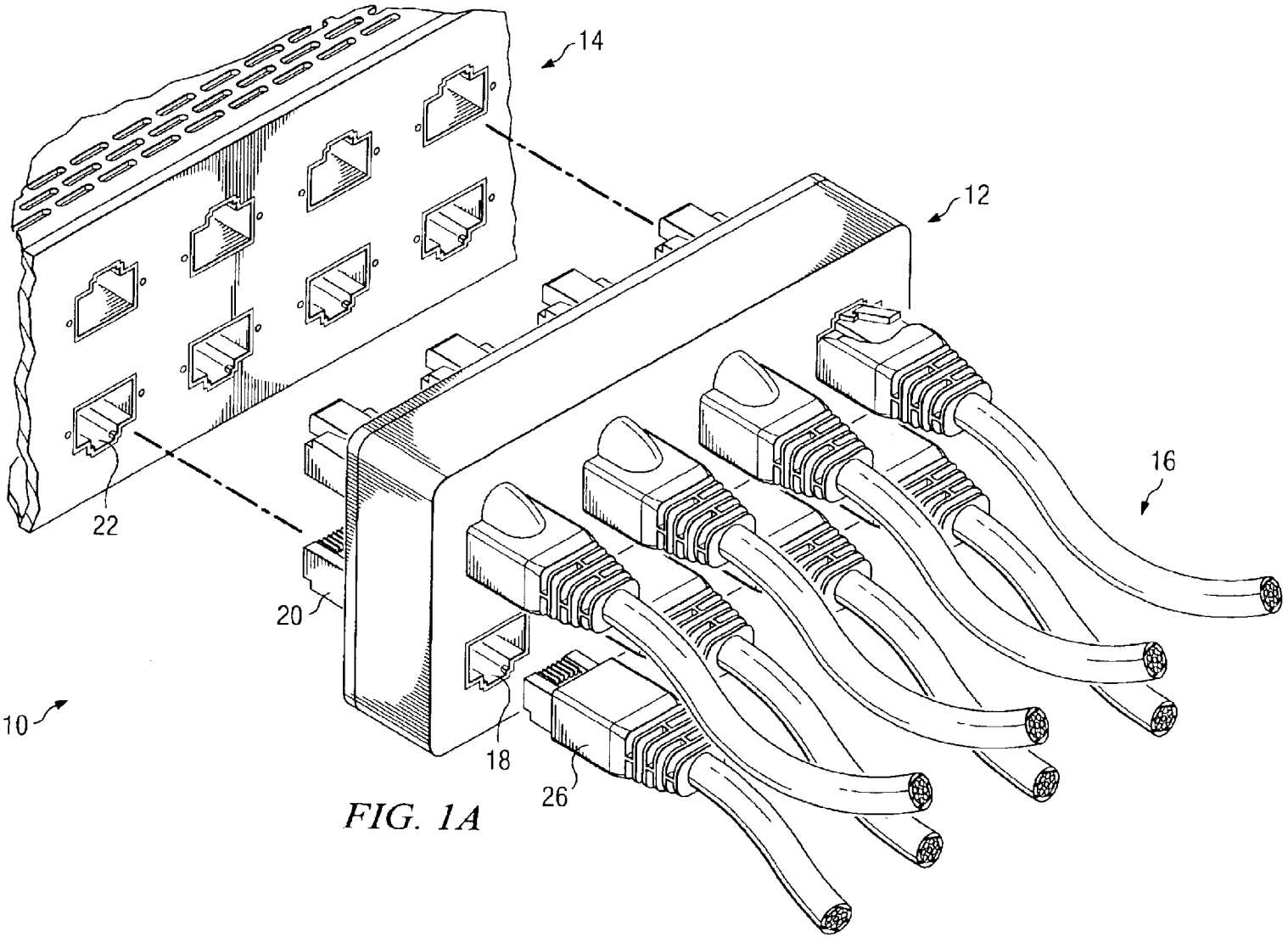
FIG. 1A is a perspective drawing of a system for coupling a plurality of cables to a device according to the teachings of the invention.

Embodiments of the invention are best understood by referring to FIGS. 1 through 4 of the drawings, like numerals being used for like and corresponding parts of the various drawings.

FIG. 1 is a perspective drawing of a system 10 for facilitating coupling of a plurality of cables to an Ethernet switch according to the teachings of the invention. System 10 includes a ganged connector, or simply connector, 12, an Ethernet switch 14, and a plurality of cables 16. According to the teachings of the invention, ganged connector 12 includes a plurality of RJ jacks 18 each coupled to a corresponding RJ plug 20 for insertion into a corresponding RJ jack 22 on Ethernet switch 14. It will be understood that the terms "RJ jack" and "RJ plug" refer to industry terminology that defines a plurality of different types of jacks and plugs, including RJ11 and RJ45, as described in great detail below. According to the teachings of the invention, coupling cables 16 to Ethernet switch 14 is facilitated by use of ganged connector 12. Cables 16 are connected to Ethernet switch 14 through ganged connector 12, thereby allowing releasable connection of all cables 16 from Ethernet switch 14 at the same time. Thus, if Ethernet switch 14 needs to be replaced, all cables 16 may be disconnected and plugged into a corresponding replacement Ethernet switch (not explicitly shown) without the need to individually disconnect each cable 16 and plug it into the correct jack 22 on the replacement Ethernet switch 14. By connecting and disconnecting cables 16 all at once, replacement time for Ethernet switches is reduced, thereby reducing the expense associated with downtime. As well, the chance for misconnecting is removed. The teachings of the invention are also applicable to connecting cables to devices other than Ethernet switches.

Figure 2:
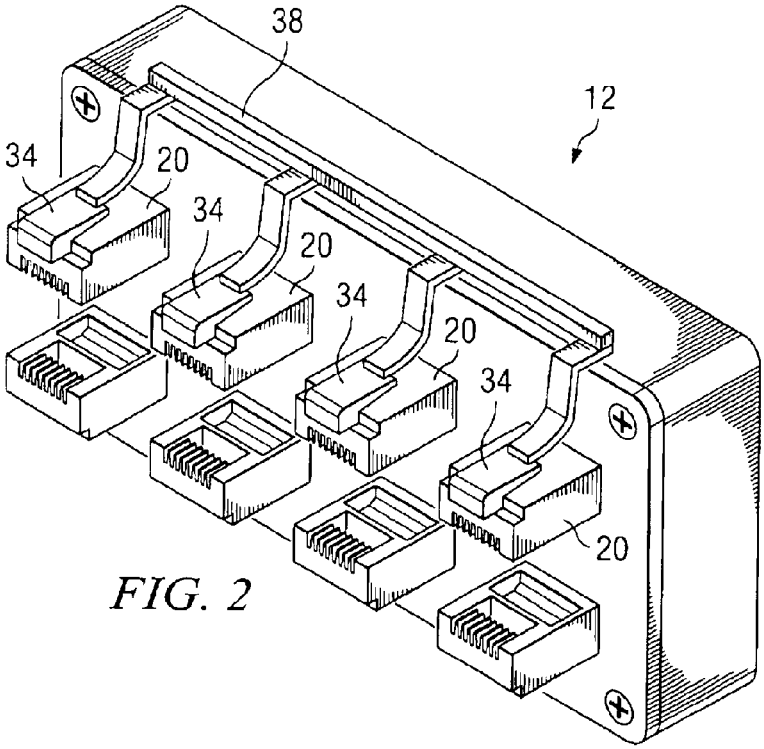
FIG. 2 is a perspective drawing showing portions of the connector of FIG. 1A according to an alternative embodiment of the invention.
Figure 3:
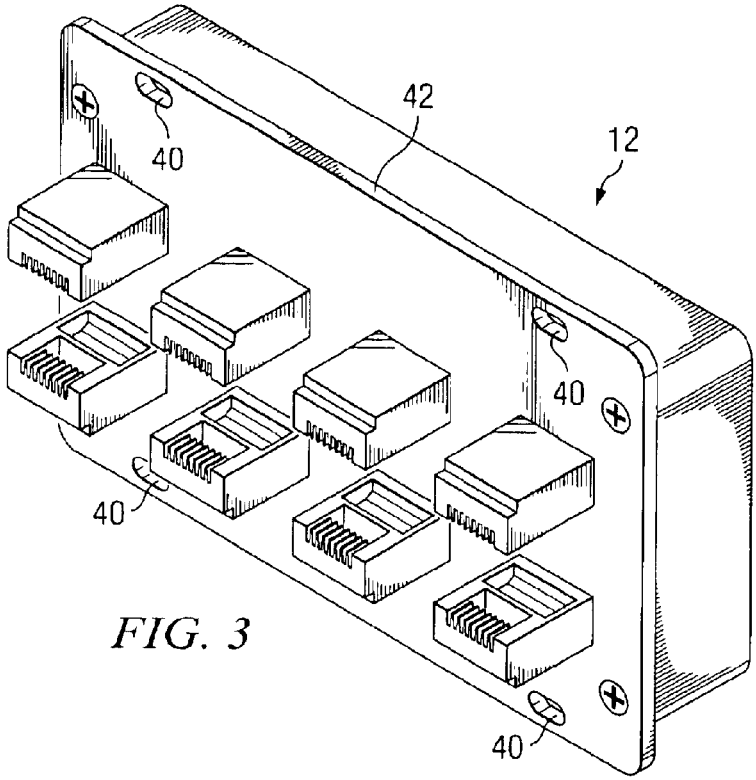
FIG. 3 is a perspective drawing showing additional details of another alternative embodiment of the connector of FIG. 1A.

Ganged connector 12 may be formed from any suitable material, including plastics and metals. In addition to jacks 18 disposed on a first side of connector 12 and plugs 20 disposed on a second side of ganged connector 12, ganged connector 12 may include, or have attached thereto, one or more latching mechanisms for individually or collectively latching RJ plugs 20 into RJ jacks 22. Example latching mechanisms are illustrated in FIGS. 1B, 2 and 3. Although many RJ jacks are conventionally formed individually with a separate latch, as used herein, RJ jack refers to the conventional RJ jack with, or without, the individual latch.

Ethernet switch 14 is utilized in this description as an example; however, other devices that utilize RJ jacks may also benefit from the teachings of the invention, including phones, computers, and other devices, regardless of whether the Ethernet communication protocol is utilized.

Cables 16 may be any suitable cables operable to be associated with respective plugs 26 for insertion into jacks 18. Jacks 18 and 22, and plugs 26 and 20 are RJ connectors. Example types of RJ connectors include RJ45, conventionally used on Ethernet switches, and RJ11, conventionally used on telephones; however, other types of RJ connectors may also be utilized.

In the illustrated embodiment, Ethernet switch 14 comprises a four by two array of plugs 22, and ganged connector 12 comprises a corresponding four by two array of plugs 20 and jacks 18; however, any suitable arrangement of plugs and jacks may be utilized according to the desired need. For example, arrays of one by four, two by four, one by eight, two by eight, one by twelve, and two by twelve, as well as others are contemplated.

In operation, plugs 26 associated with cable 16 are inserted into jacks 18 of ganged connector 12. Then plugs 20 of ganged connector 12 are inserted all at once into jacks 22 of Ethernet switch 14. Alternatively, cables 26 may be inserted into ganged connector 12 after coupling of ganged connector 12 to Ethernet switch 14. If it is desired to replace Ethernet switch 14, then ganged connector 12 is detached from Ethernet switch 14 and inserted into a corresponding replacement device. Thus individual cables 16 do not need to be disconnected and then reinserted, which would require careful matching of the correct cable to the correct jack of the corresponding replacement Ethernet device. Such operation saves downtime and reduces associated costs and removes risk of miscabling. Examples of the latching mechanism for releasably securing plugs 20, and therefore ganged connector 12, to Ethernet switch 14 are described below in connection with FIGS. 1B, 2, and 3. A flowchart illustrating an example corresponding method is described with respect to FIG. 4.

Figure 1B:
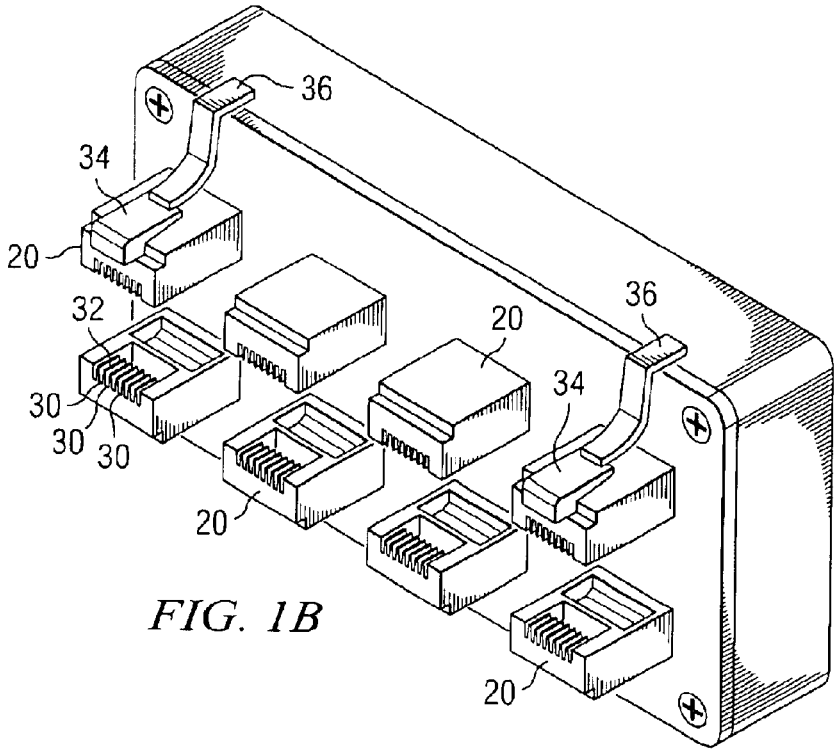
FIG. 1B is a perspective drawing showing portions of the connector of FIG. 1A according to one embodiment of the invention.

FIG. 1B is a perspective drawing showing plugs 20 associated with ganged connector 12 of FIG. 1A. In the illustrated example, plugs 20 are RJ45 plugs having a plurality of conductors 30 individually isolated from each other by a plurality of insulators 32 for electricity coupling with corresponding conductors on jacks 22 (not explicitly shown). In this example the top left and right plugs 20 each include a latch member 34. In this example, latch member 34 is the conventional latch utilized on individual RJ45 plugs; however, other types of latches may be utilized. Also illustrated in FIG. 1B are latch extensions 36 coupled to latches 34. Latch extensions 36 extend above ganged connector 12, allowing a user to depress latch extensions 36, and therefore causing latches 34 to latch or unlatch upon insertion or removal of ganged connector 12 from Ethernet switch 14. Latches 34 sufficiently secure ganged connector 12 to Ethernet switch 14, thus corresponding latches are not necessary for the other illustrated plugs 12.

Figure 1C:
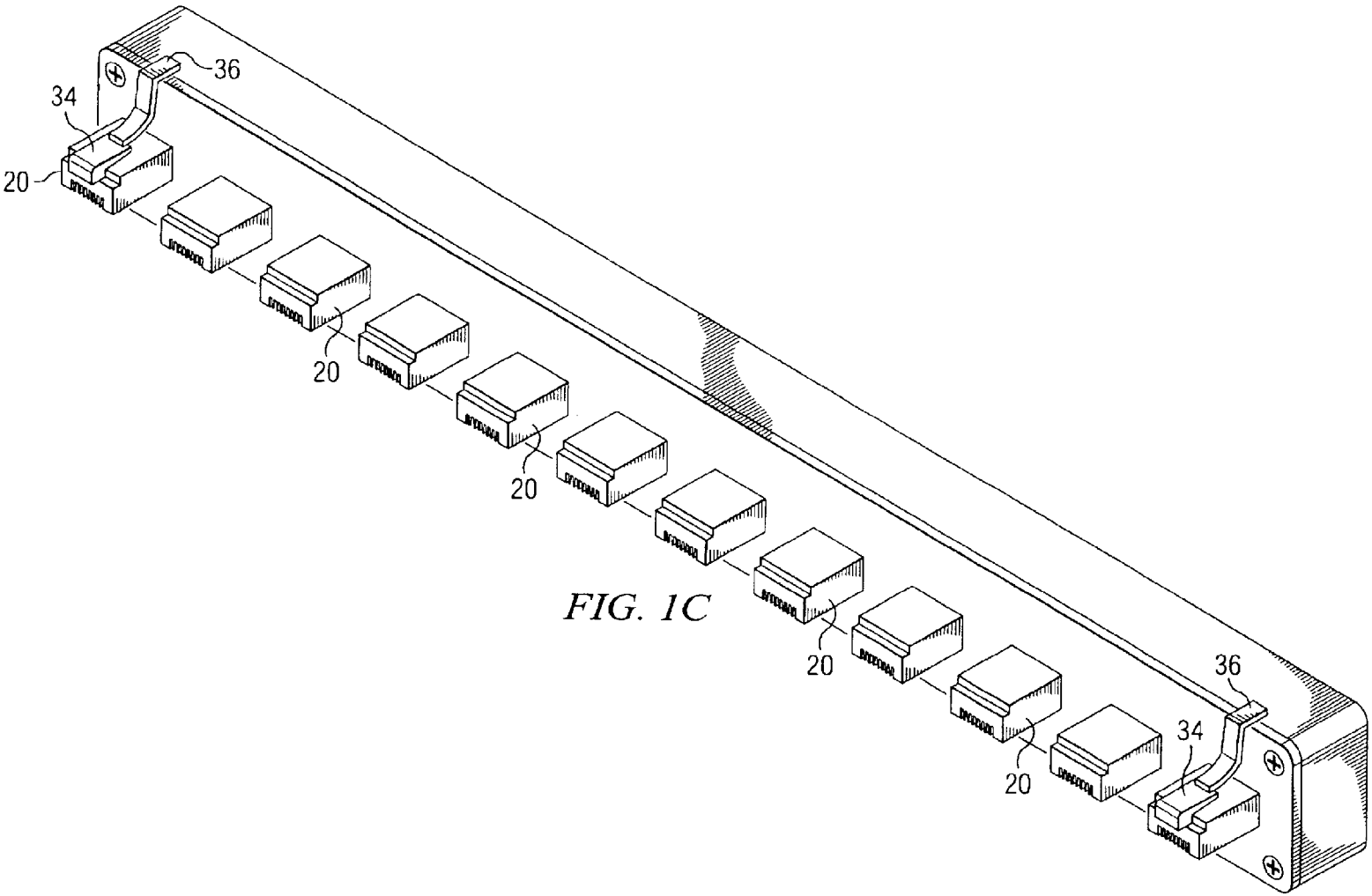
FIG. 1C is a perspective drawing showing portions of a connector according to another embodiment of the invention.

FIG. 1C is a perspective drawing showing portions of a connector according to another embodiment of the invention, which includes twelve RJ plugs 20 in one row.

FIG. 2 illustrates an alternative embodiment of ganged connector 12 utilizing a common latch extension 38. In this example, common latch extension 38 allows depressing of latches 34 on each of plugs 20 to facilitate a detachment, and does not necessarily require the use of both hands by the operator. In this example, latches 34 are shown on all plugs 20 in the top row of plugs 20; however, latches 34 are not required for all plugs 20. In addition, a second latch extension could be provided that is associated with the bottom row of plugs 20, either above, below, or to the side of ganged connector 12. In operation, a user may depress latch extension 38 in securing or detaching ganged connector 12 from Ethernet device 14, thereby causing latches 34 to latch or unlatch accordingly.

FIG. 3 is a perspective drawing showing yet another embodiment of ganged connector 12 according to the teachings of the invention. In this example, instead of utilizing a latching mechanism, apertures 40 are provided in portion 42 of ganged connector 12 in which screws or other fastening devices may attach connector 12 to Ethernet switch 14, thereby eliminating the need for any latches, such as latches 34. However, such latches 34 may also be utilized in this embodiment, as desired. In operation, ganged connector 12 may be attached or removed from Ethernet switch 14 through the use of screws or other fasteners (not explicitly shown) through apertures 40 into corresponding apertures on Ethernet device 14 (not explicitly shown).

Figure 4:
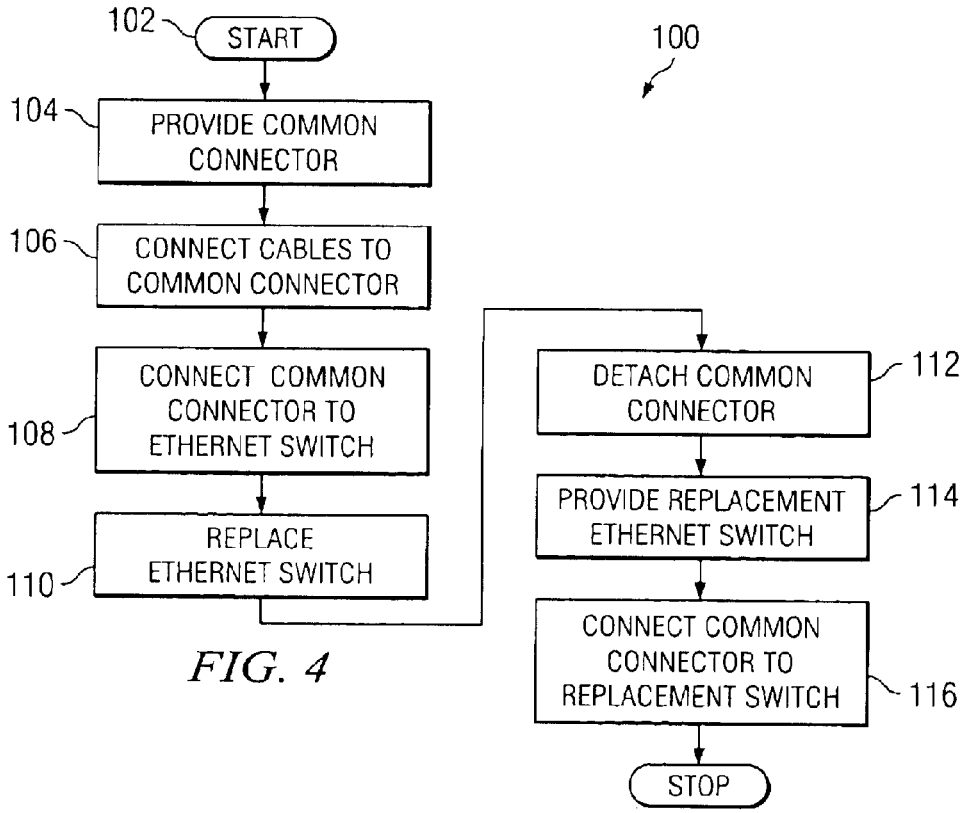
FIG. 4 is a flowchart illustrating a method for coupling a plurality of cables to an Ethernet switch.

FIG. 4 is a flowchart illustrating a method 100 for coupling a plurality of cables to an Ethernet switch. Although the below example method is described in the context of an Ethernet switch, the teachings of the invention are applicable to other devices to which cables are desired to be connected. The method begins at step 102. At a step 104 a common connector is provided. Such a common connector could take the form of ganged connector 12, or other form. In general, the common connector is a device that allows connection of a plurality of cables to it and that can be connected in a single installation to a device to which cables are desired to be connected. At a step 106, the cables are connected to the common connector, and at step 108 the common connector is connected to the Ethernet switch (or other device).

At a step 110, it may be desired to replace the Ethernet switch, in which case the common connector is detached from the Ethernet switch, thereby decoupling all cables at once from Ethernet switch 14. At step 114 a replacement Ethernet switch is provided, and at step 116 the common connector is connected to the replacement Ethernet switch, thereby coupling all cables to the Ethernet switch. As described above such an approach reduces downtime, thereby reducing costs associated with replacing an Ethernet switch. It will be understood that various ones of the above acts could occur in varying order, as desired. For example, the order of steps 106 and 108 could be switched.

Although the present invention has been described in detail, it should be understood that various changes, substitutions, and alterations can be made hereto without departing from the spirit and scope of the invention as defined by the appended claims.

What is claimed is:

1. An apparatus comprising:

a housing having a first side and a second side;

a plurality of RJ plugs attached to the first side of the housing;

a plurality of RJ jacks disposed within the second side of the housing, each RJ jack electrically connected to a corresponding one of the plurality of RJ plugs on the first side of the housing; and a securing mechanism associated with at least one of the plurality of plugs and operable to releasably connect the plurality of plugs to a second plurality of RJ jacks on a device, thereby facilitating insertion of the plurality of plugs into the second plurality of jacks.

2. The apparatus of claim 1, wherein the plurality of RJ plugs comprises eight RJ plugs configured in two rows of four plugs.

3. The apparatus of claim 1, wherein the plurality of RJ plugs comprises a plurality of RJ45 plugs.

4. The apparatus of claim 1, wherein the plurality of RJ plugs comprises a plurality of RJ11 plugs.

5. The apparatus of claim 1, wherein the securing mechanism comprises a common latch connected to at least two RJ latches on the RJ plugs.

6. The apparatus of claim 1, wherein the securing mechanism comprises at least one latch extension connected to an RJ latch of at least one RJ plug.

7. The apparatus of claim 1, wherein the securing mechanism comprises at least one fastener disposed through a corresponding aperture of the housing.

8. The apparatus of claim 1, wherein the plurality of RJ plugs comprises one row of twelve plugs.

9. The apparatus of claim 1 and further comprising a plurality of cables inserted, in a one-to-one fashion, into the plurality of RJ jacks disposed within the second side of the housing.

10. The apparatus of claim 9, and further comprising the device formed with the second plurality of RJ jacks, wherein the plurality of RJ plugs is disposed within, in a one-to-one fashion, the second plurality of RJ jacks in the device.

11. An apparatus comprising:

an Ethernet switch having at least four RJ45 jacks disposed therein;

at least four Ethernet cables connected in a one-to-one fashion to the at least four RJ45 jacks;

a ganged cable connector releasably coupling the Ethernet switch to the cables, comprising:

a housing having a first side and a second side opposite the first side;

at least four RJ45 plugs attached to the first side of the housing and connected to the at least four RJ45 jacks disposed in the Ethernet switch;

at least four RJ45 jacks disposed within the second side of the housing and each electrically connected to a corresponding one of the plurality of RJ45 plugs on the first side of the housing and electrically connected to a corresponding one of the at least four Ethernet cables; and a latch deflection bar coupled to at least two of the RJ45 plugs disposed within the second side of the housing and operable to displace a latch on each of the at least two of the RJ45 plugs in response to deflection of the deflection bar, thereby latching the at least two of the RJ45 plugs into the corresponding RJ45 jacks and securing the ganged cable connector to the Ethernet switch.

12. The apparatus of claim 11, wherein the at least four RJ45 plugs comprises two rows of four RJ45 plugs.

13. The apparatus of claim 11, wherein the at least four RJ45 plugs comprising one row of four RJ45 plugs.

14. A method for facilitating releasable coupling of a plurality of RJ plugs into a device comprising:

providing a housing having a first plurality of RJ plugs on a first side and a plurality of RJ jacks on a second side;

coupling a plurality of cables each having respective RJ plugs to respective ones of the plurality of RJ jacks;

coupling the first plurality of RJ plugs to a second plurality of RJ jacks on the device, thereby facilitating releasable coupling of the first plurality of RJ plugs to the device.

15. The method of claim 14, wherein providing the housing having the first plurality of RJ plugs comprises providing a housing having at least four RJ45 plugs.

16. The method of claim 14, wherein providing the housing having the first plurality of RJ plugs further comprises providing a housing having at least one latching mechanism for displacing at least an associated latch on at least one of the first plurality of RJ plugs.

17. The method of claim 14, wherein the first plurality of RJ plugs comprises at least four RJ11 plugs.

18. The method of claim 14, and further comprising decoupling the first plurality of RJ plugs on the second plurality of RJ jacks simultaneously by removing the housing from the device.

19. The method of claim 14 and further comprising coupling the first plurality of RJ plugs to a replacement device for the device.

20. An apparatus comprising:

a housing having a first side and a second side;

a plurality of RJ plugs attached to the first side of the housing;

a plurality of RJ jacks disposed within the second side of the housing, each RJ jack electrically connected to a corresponding one of the plurality of RJ plugs on the first side of the housing; and a means associated with at least one of the plurality of RJ plugs for releasably securing the plurality of RJ plugs to a second plurality of RJ jacks on a device.

* * * * *